US008234978B1

(12) United States Patent
Bond et al.

(10) Patent No.: US 8,234,978 B1
(45) Date of Patent: Aug. 7, 2012

(54) HAND-HELD FIRING DEVICE

(75) Inventors: Thomas L. Bond, Washington, IN (US); Jerry Shrum, Gosport, IN (US); Barbara Robinson, Bloomington, IA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/983,115

(22) Filed: Dec. 31, 2010

(51) Int. Cl.
*C06C 5/06* (2006.01)

(52) U.S. Cl. ..... 102/275.11

(58) Field of Classification Search ..... 42/69.01–69.03, 42/65, 1.12, 106, 90, 41; 89/27.11, 27.12, 89/27.3, 27.14; 102/275.11, 275.12, 275.6
See application file for complete search history.

(56) References Cited

U.S. PATENT DOCUMENTS

| | | | | |
|---|---|---|---|---|
| 1,474,377 | A * | 11/1923 | Myers | 60/39.823 |
| 2,757,474 | A * | 8/1956 | Williams | 42/1.08 |
| 2,947,220 | A * | 8/1960 | Laager | 89/1.1 |
| 3,174,246 | A * | 3/1965 | Martin | 42/1.08 |
| 3,214,857 | A * | 11/1965 | Tyrone et al. | 42/1.08 |
| 3,641,868 | A * | 2/1972 | Reed | 89/1.813 |
| 6,272,996 | B1 | 8/2001 | O'Brien et al. | |
| 6,581,519 | B1 * | 6/2003 | Adams | 102/275.11 |
| 7,069,862 | B2 | 7/2006 | Bassett | |
| 7,490,554 | B2 | 2/2009 | Lynch et al. | |
| 7,708,178 | B2 | 5/2010 | Bassett | |
| 2005/0126418 | A1 | 6/2005 | Lynch et al. | |
| 2008/0245253 | A1 | 10/2008 | Lynch et al. | |
| 2008/0282923 | A1 | 11/2008 | Lynch et al. | |

FOREIGN PATENT DOCUMENTS

| | | |
|---|---|---|
| WO | WO 03/071220 | 8/2003 |

* cited by examiner

*Primary Examiner* — Bret Hayes
*Assistant Examiner* — Reginald Tillman, Jr.
(74) *Attorney, Agent, or Firm* — Christopher A. Monsey

(57) ABSTRACT

An apparatus is disclosed to initiate detonation. The apparatus includes a first hollow cylinder, a second hollow cylinder laterally spaced from the first hollow cylinder, each of the first and second hollow cylinders having an inner surface and an outer surface, and extending longitudinally between a first end and a second end. A spring is disposed in each of the first and second cylinders, and a firing pin is disposed in each of the first and second cylinders, wherein the spring is positioned between the first end of each of the first and second cylinders and the firing pin. A sear lever is in communication with each of the firing pins, and bushings are disposed between the sear lever and each of the first and second hollow cylinders, positioned so that the sear lever is insulated from contact of the outer surface of the hollow cylinders.

33 Claims, 8 Drawing Sheets

HAND-HELD FIRING DEVICE

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon.

BACKGROUND OF THE INVENTION

The present invention relates generally to devices for initiating detonation of a non-electric detonator.

Non-electric detonators may be used to initiate detonation of larger explosives, such as, for example, a shaped charge or explosives used to create an opening in a building's wall or a gate. Hand held firing devices are known to include a firing pin or other sharp object to strike non-electric detonators to cause ignition thereof. The non-electric detonator may be created so that the firing pin must strike the detonator in a specific location and with a specific force, in order to prevent inadvertent or unintentional detonation.

A user may desire a safe and reliable way of triggering a non-electric detonator, so that the requirements to detonate the non-electric detonator are met in a reliable and reproducible manner.

SUMMARY OF THE INVENTION

In an exemplary embodiment of the present disclosure, a firing device apparatus is provided. The apparatus includes a first hollow cylinder. The apparatus further includes a second hollow cylinder laterally spaced from, and extending substantially parallel to, the first hollow cylinder, each of the first and second hollow cylinders having a longitudinal axis, an inner surface and an outer surface, and extending longitudinally between a first end and a second end. The apparatus further includes a spring disposed in each of the first and second hollow cylinders. The apparatus further includes a firing pin disposed in each of the first and second hollow cylinders, wherein each spring is positioned between the first end of one of the first and second cylinders and the respective firing pin. The apparatus further includes a lever structure having a portion extending substantially perpendicular to the longitudinal axis of the first and second hollow cylinders, and coupled to the firing pins disposed in each of the first and second hollow cylinders through openings in the first and second hollow cylinders. The lever structure is positioned outside of the first and second hollow cylinders and is configured to move longitudinally in response to movement of the firing pins. A first bushing is disposed between the first portion of the lever structure and the first hollow cylinder, the first bushing being interposed within the opening of the first hollow cylinder. A second bushing is disposed between the first portion of the lever structure and the second hollow cylinder, the second bushing being interposed within the opening of the second hollow cylinder.

In another exemplary embodiment of the present disclosure, a method for initiating a detonator is provided. The method includes coupling a detonator to a hollow cylinder of a firing device, adjusting a stop lock screw to define a set point for a firing pin supported for sliding movement within the hollow cylinder, providing a sear lever external to the cylinder and supported for movement with the firing pin, providing a trigger to secure the sear lever in a firing position, activating the trigger to release the sear lever and causing a spring to move the firing pin into contact with the detonator, and insulating the sear lever from the cylinder during movement therebetween.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

Figure 1:
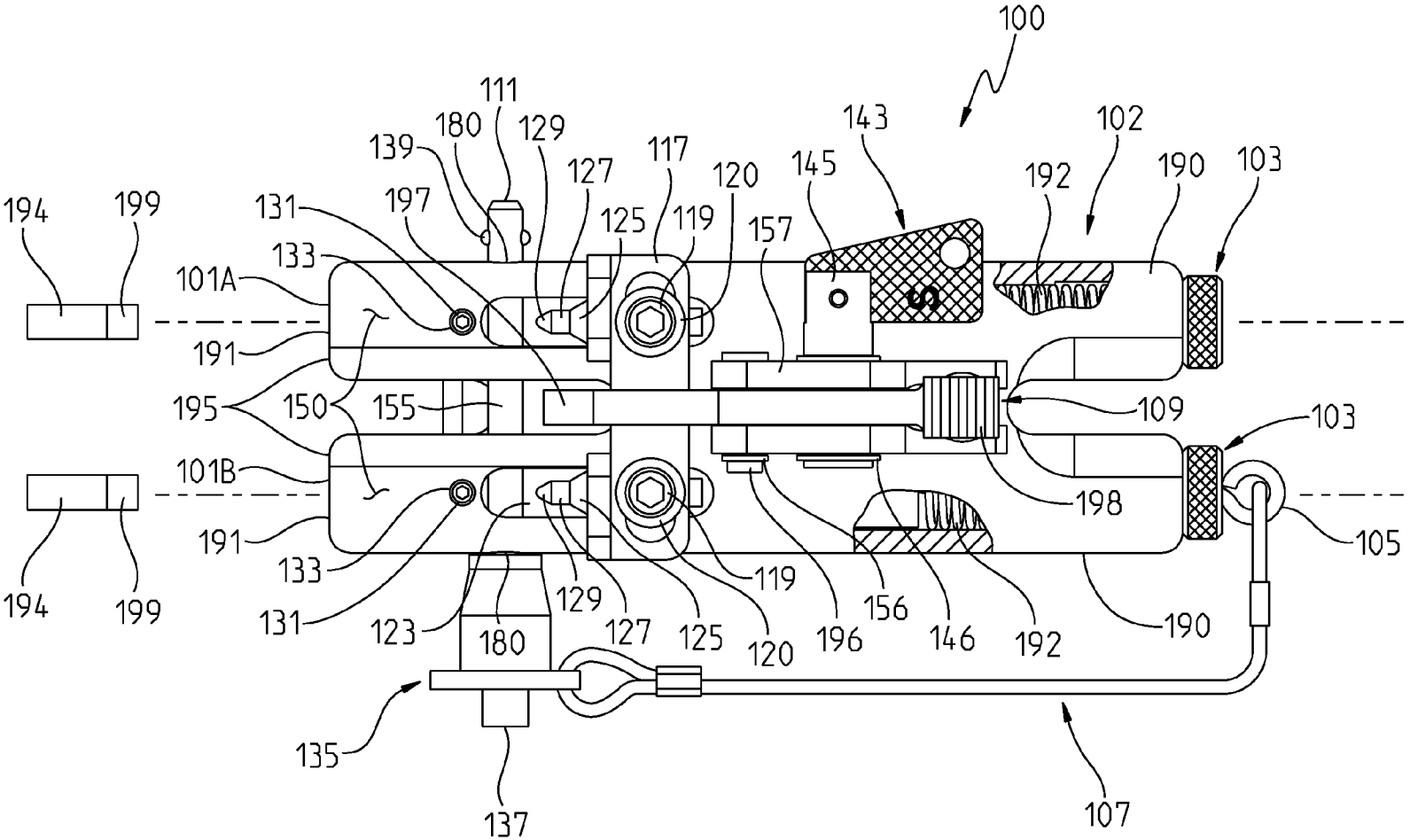
FIG. 1 is a top view of a firing device according to an embodiment of the present disclosure.
Figure 2:
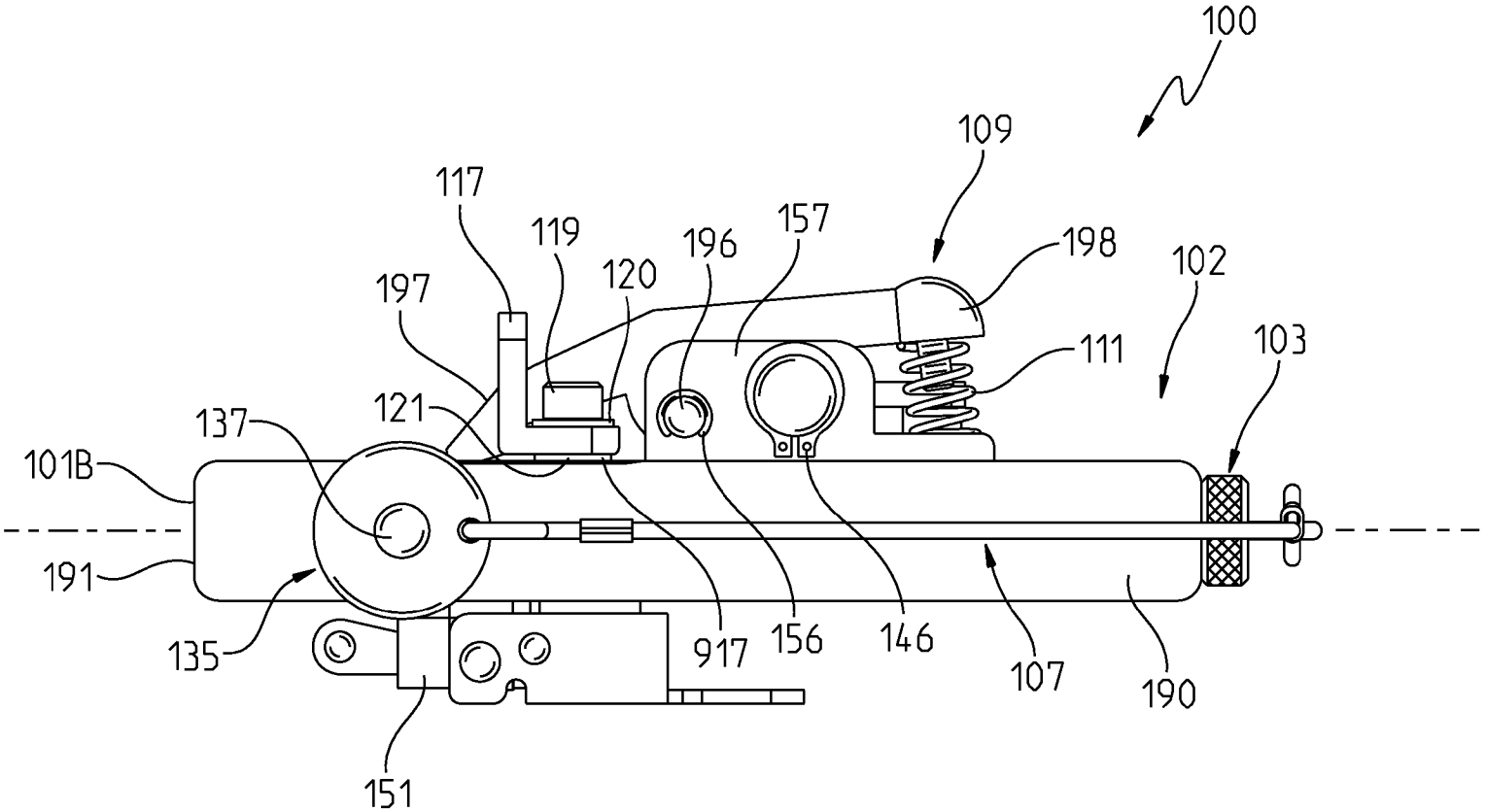
FIG. 2 is a side view of the firing device according to an embodiment of the present disclosure shown in FIG. 1.
Figure 3A:
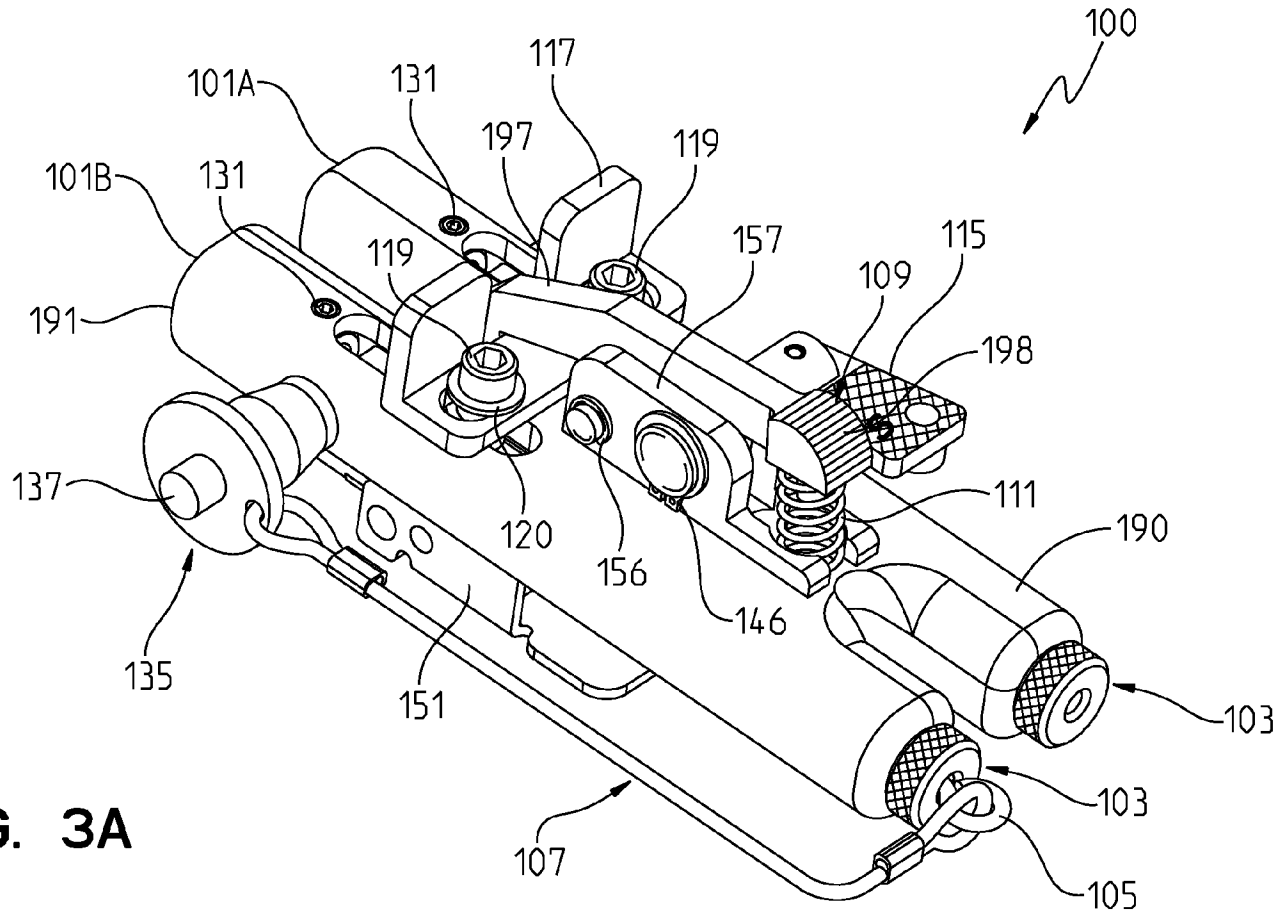
FIG. 3A is a rear perspective view of the firing device according to an embodiment of the present disclosure shown in FIG. 1.
Figure 3B:
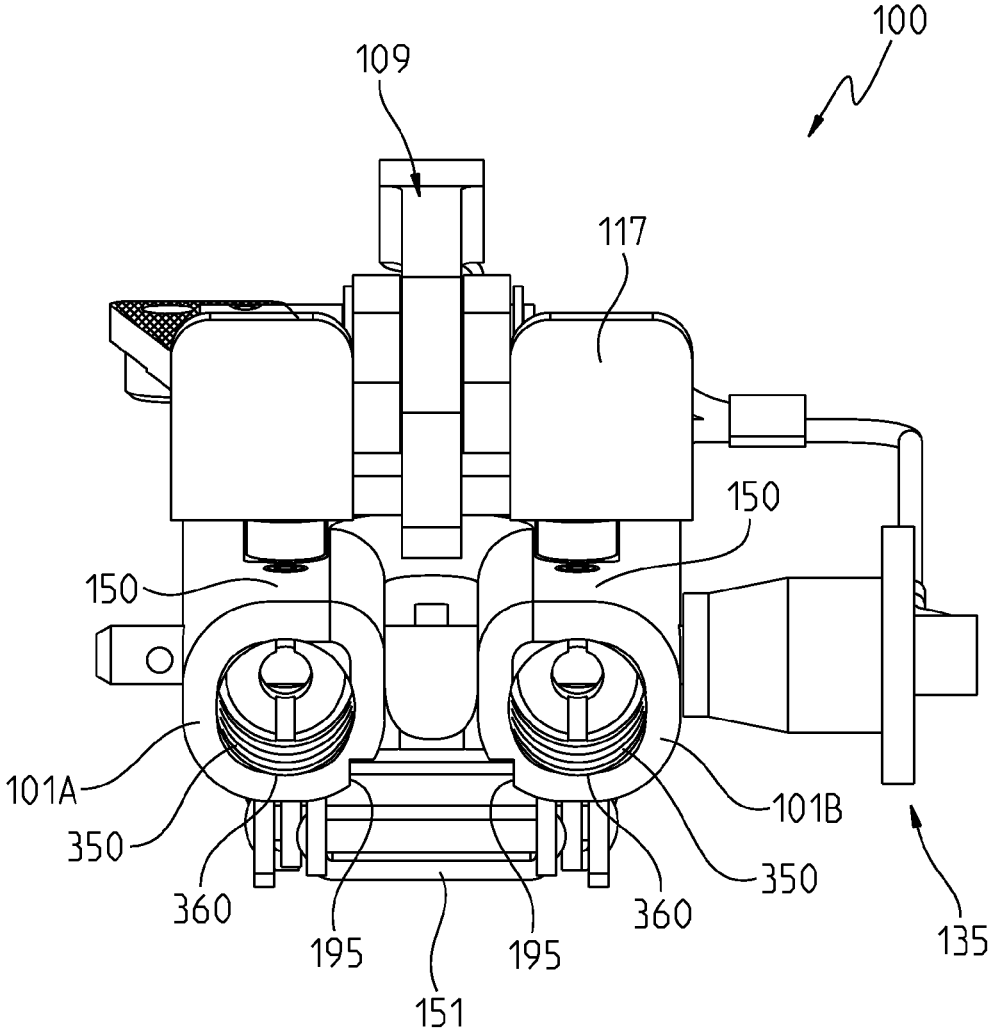
FIG. 3B is a front perspective view of the firing device according to an embodiment of the present disclosure shown in FIG. 1.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Referring to FIGS. 1-3 and 9, a top view, side view, rear perspective view, and exploded view of a firing device 100 is shown according to an embodiment of the present disclosure. As further detailed herein, firing device 100 is configured to receive at least one non-electric detonator 194 for initiation thereof. In turn, the non-electric detonator 194 is in communication with a fuse, illustratively a non-electric detonator cord (not shown). As known, the detonator cord may comprise a tube with an explosive core and is configured to detonate a main explosive charge (not shown).

The firing device 100 may include a body 102 having first and second hollow cylinders 101A, 101B laterally spaced and extending in a longitudinal direction. A threaded cap 103, a spring 192, a firing pin 125, and a firing pin stop lock screw 131 are associated with each of the cylinders 101A, 101B. A laterally extending lever structure or sear lever 117 is operably coupled to the firing pins 125 of each cylinder 101A, 101B. A trigger 109 may pivot within a trigger attachment bracket 157, and may catch and release the sear lever 117 from a firing (retracted) position to a fired (extended) position. A trigger safety 143 and a secondary safety 135 may be used to prevent accidental release of the sear lever 117 (i.e., provide alternate safe and firing modes when the sear lever is in the firing position).

The cylinders 101A, 101B may be metal, for example an aluminum or aluminum alloy, and may be attached together or may be milled from a single block of metal defining body 102. While FIG. 1 shows two cylinders 101A, 101B, embodiments may include one cylinder, or more than two cylinders 101A, 101B attached together or milled from a single block of material. The cylinders 101A, 101B may be hollow, and may be joined together via a bridge 155 or other connecting surface. The bridge 155 may be milled with the cylinders 101A, 101B, or the cylinders 101A, 101B may be joined to the bridge 155. The cylinders 101A, 101B may include a first end 190 and a second end 191, and the first end 190 and the second end 191 may be open. The first end 190 and the second end 191 may include threads 350 disposed along the inner surface 360 of the cylinder walls, and the inner surface 360 of the cylinder walls may otherwise be unthreaded. The cylinders 101A, 101B may also include one or more indentations or recesses 195 on the outer surface of the cylinders 101A, 101B. The indentations 195 may allow for the seating of one or more non-electric detonators. For example, the non-electric detonators may have one or more projections that seat within the indentations 195, or the non-electric detonators may be sized so that the indentations 195 are necessary so that the firing pin 125 may strike the non-electric detonator. The cylinders 101A, 101B may be of a thickness to allow the cylinders 101A, 101B to be durable against use and/or wear. For example, the cylinders 101A, 101B may be sized so that they are able to withstand repeated forces from inserting and/or removing detonators, or from forces sustained during the initiation of one or more detonators. The cylinders 101A, 101B may also include a flat portion 150 that may provide a cooperating surface for the sear lever 117 and/or bushings 121.

The inner and/or outer surface of the cylinders 101A, 101B may be coated with a material, or anodized, or may be treated with another chemical or mechanical process to alter its properties. For example, the outer surface may be anodized to create a substantially unreflective matte surface or to strengthen wear resistance, or the outer surface may be painted. The inner surface and/or the outer surface may also be treated to alter its properties. For example, and without limitation, the inner surface may be anodized, painted, or polished, or a layer of oil, a fluoropolymer such as Teflon®, or other substance may be applied to protect the inner surface from corrosion, to reduce wear, or to increase reliability.

In addition to the openings at the first end 190 and the second end 191, each of the cylinders 101A, 101B also includes a sear lever opening 123, a stop lock screw opening 133, and two secondary safety openings 180. The sear lever opening 123 and the stop lock screw opening 133 are openings in the cylinders 101A, 101B from the outer surface to the inner surface. The sear lever opening 123 allows for the connection between a sear lever 117 and a firing pin 125, and also for the movement of the sear lever 117 and firing pin 125 within the cylinder, described more fully below. The stop lock screw opening 133 allows for the installation of a stop lock screw 131, described more fully below. The secondary safety openings 180 are positioned between the firing pin stop lock screw openings 133 and the sear lever openings 123, and are arranged along an axis that is perpendicular to the longitudinal axis of the cylinder. In an embodiment, the secondary safety openings for each of the cylinders 101A, 101B are arranged along a single perpendicular axis to the cylindrical axes of the cylinders 101A, 101B.

Figure 4:
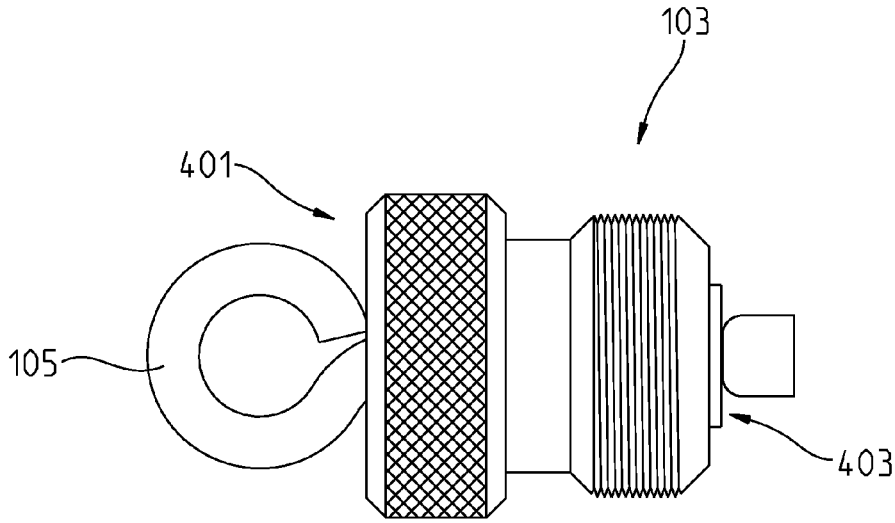
FIG. 4 is a top view of a threaded cap according to an embodiment of the present disclosure.

Also described with reference to FIG. 4, the threaded cap 103 is attached to the first end 190 of each of the cylinders 101A, 101B. The threaded cap 103 may be stamped or milled, and may be aluminum or another metal, and are installed within the cylinders 101A, 101B so that the springs 192 rest against a fixed object. The threaded cap 103 may include threads along the outer surface that are comparable to the threads disposed along the inner surface of the first end 190 of the cylinders 101A, 101B, and may engage with the cylinder inner surface threads to releasably engage the threaded cap 103 with the first end 190 of the cylinders 101A, 101B. The first end 401 of the threaded cap 103 may include projections or indentations to facilitate turning the threaded cap 103 to engage with the first end 190 of the cylinders 101A, 101B. The threaded cap 103 may be cylindrical, and may be closed on the first end 401. In an embodiment, the threaded cap 103 may also be closed on the second end 403. One or more of the threaded caps 103 engaged with the cylinders 101A, 101B may also include an eye hook 105. The eye hook 105 may be affixed to the first closed end 401 of one or more of the threaded caps 103, or may be releasably attached to the threaded cap 103 by, for example and without limitation, threads that may engage threads formed within a void through the first end 401 of the threaded cap 103. In another embodiment, the first end 401 of the cylinder is closed, and a threaded cap 103 is not provided.

Springs 192 may be a metal, for example steel or steel alloy, and are disposed within each of the cylinders 101A, 101B, so that the springs 192 may rest against the inner surface of the first end 401 of the threaded cap 103 that is engaged with the first end 190 of the cylinder. In an embodiment, if the second end 403 of the threaded cap 103 is closed, the spring 192 disposed within the cylinder may rest against the outer surface of the second end 403 of the threaded cap 103. The springs 192 may be compressible along the cylindrical axis of each of the cylinders 101A, 101B. The springs 192, in the illustrative embodiment, are closed springs and may be compressed so that each spring 192 pushes its associated firing pin 125 to strike a non-electric detonator with at least 675 pounds of force.

Figure 5:
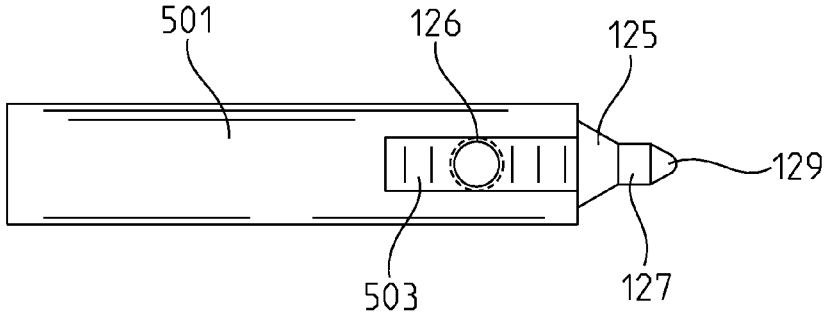
FIG. 5 is a top view of a firing pin according to an embodiment of the present disclosure.

Shown also in FIG. 5, firing pins 125 may be a metal, for example steel or steel alloy, and are disposed within each of the cylinders 101A, 101B, so that within each of the cylinders 101A, 101B, the spring 192 is between the firing pin 125 and the threaded cap 103. Each firing pin 125 may include a spring end 501, which may be circular. The spring end 501 may have a diameter that is slightly smaller than the inner diameter of the cylinders 101A, 101B, so that the firing pin 125 may move along the cylindrical or longitudinal axis of the cylinders 101A, 101B, but may not rotate in an axis that is perpendicular to the cylindrical axis of the cylinders 101A, 101B. The pin end 129 of the firing pin 125 may be a different metal than the spring end 501, and the pin end 129 and the spring end 501 may be joined together by, for example and without limitation, welding or other bonding, or the pin end 129 and the spring end 501 may be the same material. The pin end 129 may taper 127 to a point as the pin end 129 extends in the direction of the second end 191 of the cylinders 101A, 101B. The spring end 501 of the firing pin 125 may be affixed to the spring 192, or the spring end 501 may not be affixed to the spring 192, so that the firing pin 125 rides along the cylindrical axis of the cylinders 101A, 101B. The firing pins 125 may also include a flat portion 503 to engage or seat the bushings 121.

Firing pin stop locks 132 may be a metal, such as stainless steel. The firing pin stop locks 132 may be substantially cylindrical and may be threaded on the outer surface. The threads of the outer surface of the firing pin stop locks 132 may engage with the threads on the inner surface of the cylinders 101A, 101B, so that rotation of the firing pin stop locks 132 within the cylinders 101A, 101B moves the firing pin stop locks 132 along the longitudinal axis of the cylinders 101A, 101B. The firing pin stop locks 132 may be hollow, so that the pin end 129 of the firing pins 125 may extend through the firing pin stop locks 132, but the firing pins 125 may be constrained from further forward movement along the cylindrical axis of the cylinders 101A, 101B by the firing pin stop locks 132. The depth that the firing pins 125 are allowed to extend in the cylinders 101A, 101B may be controlled by the positioning of the firing pin stop locks 132 within the cylinders 101A, 101B. In other words, the firing pin stop locks 132 establish a detonator set point or limit stop for the travel of the firing pin 125 axially within the cylinder 101A, 101B. The firing pin stop locks 132 may be adjustable so that the firing pin 125 effectively contacts and initiates detonators of differing sizes, as shown more fully below.

Firing pin stop lock screws 131 may be a metal, such as stainless steel. The firing pin stop lock screw 131 may be substantially cylindrical and may include threads disposed on the outer surface. The threads of the firing pin stop lock screw 131 may engage with threads disposed on the inner surface of the firing pin stop lock screw opening 133 on the cylinders 101A, 101B, so that the firing pin stop lock screw 131 may be engaged with the cylinders 101A, 101B. The firing pin stop lock screw 131 may extend into the cylinders 101A, 101B, and the depth of extension of the firing pin stop lock screw 131 into the cylinders 101A, 101B may be adjusted by rotating the firing pin stop lock screw 131. The firing pin stop lock screw 131 may be adjusted so that the end of the firing pin stop lock screw 131 that extends into the cylinders 101A, 101B may contact the firing pin stop lock 132, and may limit rotation of the firing pin stop lock 132 within the cylinders 101A, 101B.

Figure 6C:
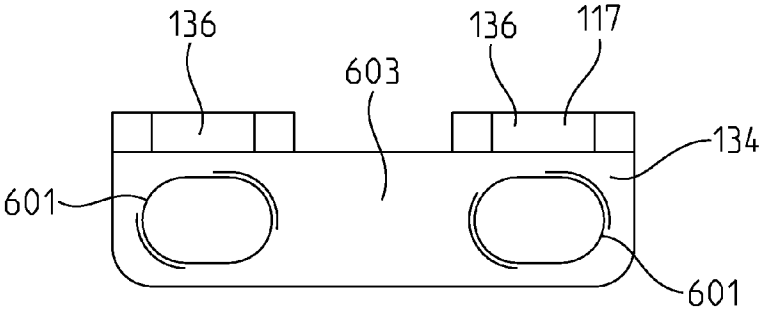
FIG. 6C is a top view of the sear lever of FIG. 6A according to an embodiment of the present disclosure.
Figure 6B:
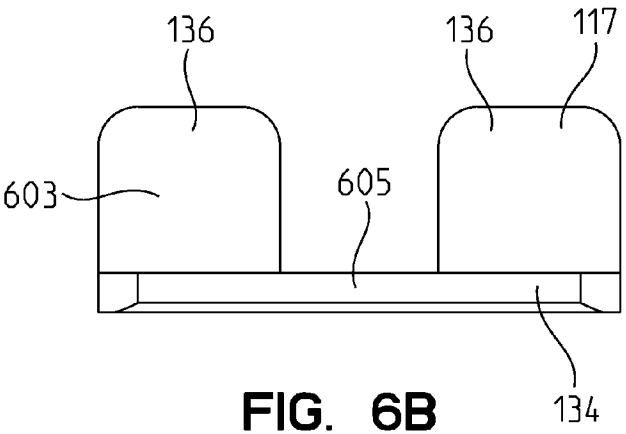
FIG. 6B is a front view of the sear lever of FIG. 6A according to an embodiment of the present disclosure.
Figure 6A:
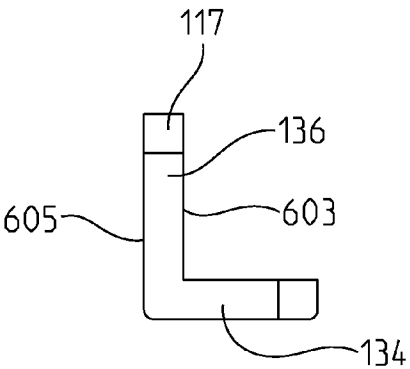
FIG. 6A is a side view of a sear lever according to an embodiment of the present disclosure.

Shown also in FIGS. 6A-6C, the sear lever 117 may be positioned over the cylinders 101A, 101B. The sear lever 117 may be a metal, for example stainless steel, and may be positioned above the sear lever openings 123 of the cylinders 101A, 101B. The sear lever 117 may be positioned so that bushings 121 are located between the sear lever 117 and the cylinders 101A, 101B. A base 134 of the sear lever 117 extends substantially parallel to the longitudinal axes of the cylinders 101A, 101B and supports a pair of upwardly extending tabs 136. The tabs 136 extend substantially perpendicular to the longitudinal axes of the cylinders 101A, 101B and may be engaged by an operator's fingers when resetting the firing pins 125 as further detailed herein.

Figure 9:
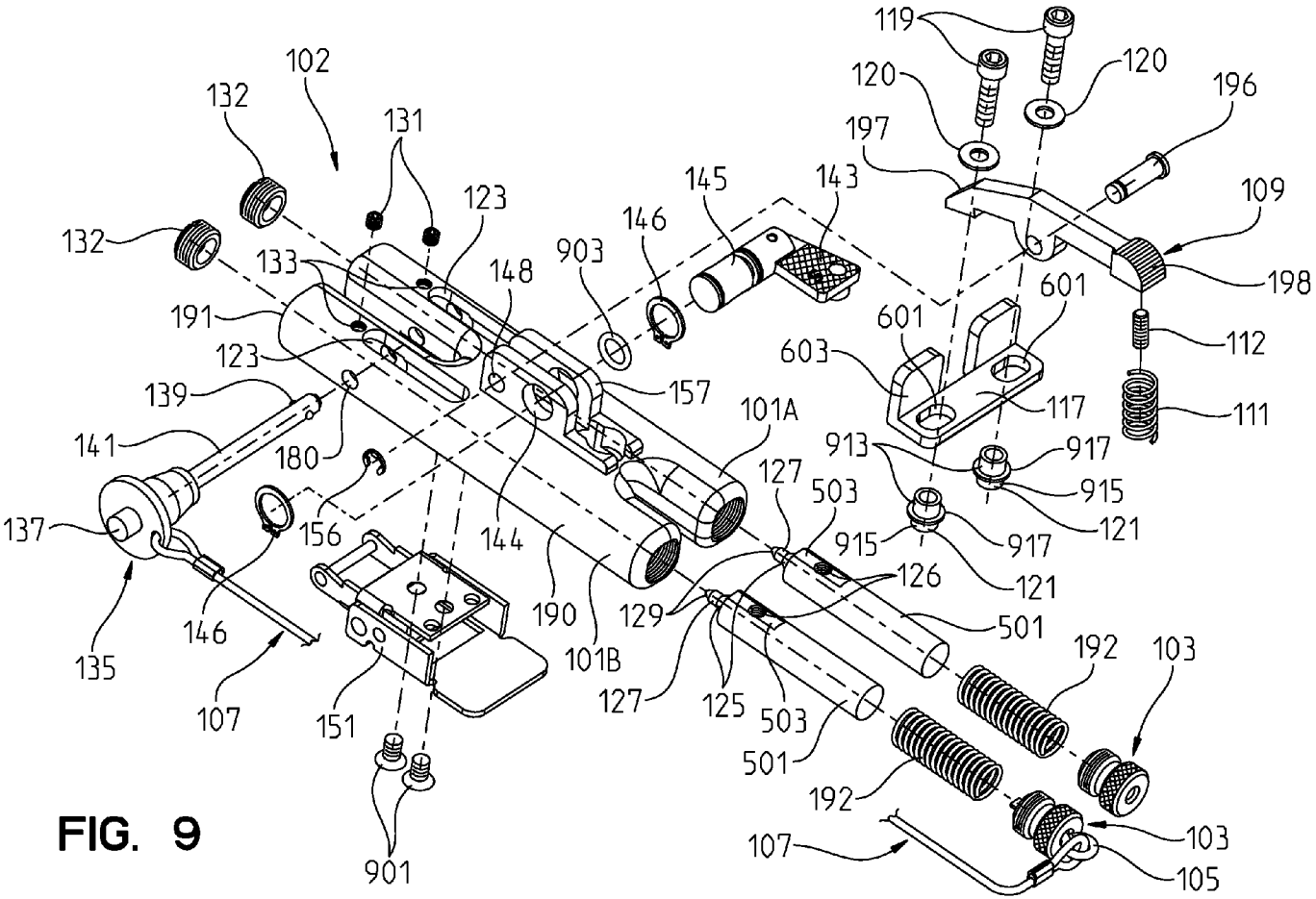
FIG. 9 is an exploded view of the firing device shown in FIG. 1 according to an embodiment of the present disclosure.

The bushings 121 may be a softer metal than the sear lever 117 and/or the cylinder or may be another material that is softer than the sear lever 117 and/or the cylinder, to prevent the sear lever 117 from being in direct contact with the cylinder. The bushings 121 may be in contact with a flat portion 503 of the firing pins 125, shown in FIG. 5. In an embodiment, the bushings 121 may be stainless steel. In another embodiment, the bushings 121 may be molded from a polymer, such as a nylon or one or more fluoropolymer compounds. As shown in FIG. 9, the bushings 121 may illustratively include a first portion 913 and a second portion 915, with a flange portion 917 separating the first portion 913 from the second portion 915. The first portion 913 may extend through the sear lever opening 123 and abut the flat portion 503 of the firing pins 125. The second portion 915 may extend through the voids 601 of the sear lever 117 and abut the washers 120 or the screws 119. The flange portion 917 may separate the sear lever 117 from the cylinders 101A, 101B, and may abut the flat portion 150 of the cylinders 101A, 101B. Additionally, an oil, graphite, or other liquid or solid lubricant may be applied between the sear lever 117 and the cylinders 101A, 101B, or between the bushings 121 and the cylinders 101A, 101B, to reduce wear, decrease friction, or increase resistance or longevity. The second portion 915 of the bushings 121 may contact an inner surface of the sear lever opening 123, and a similar liquid or solid lubricant may also be applied between the second portion 915 of the bushings 121 and the sear lever opening 123. The bushings 121 may be a wearable component, and so the bushings 121 may wear and be replaced prior to the sear lever 117 and/or cylinders 101A, 101B.

The sear lever 117 may include one or more voids 601 from the top surface 603 of the sear lever 117 to the bottom surface 605 of the sear lever 117 in contact with the bushings 121. Illustratively, one void 601 is associated with each sear lever opening 123. Firing pin couplers 119, illustratively screws or other fasteners, extend from the top surface 603 of the sear lever 117, through the sear lever 117 to the bottom surface 605 of the sear lever 117, through the bushings 121, and through the sear lever opening 123. The screws 119 may be offset from the sear lever 117 by one or more washers 120. Each screw 119 is illustratively received within a threaded hole 126 or other attachment point on the firing pin 125. The screw 119 or other fastener may thus couple the sear lever 117 to the firing pin 125. In another embodiment, the sear lever 117 may be fastened to the firing pin 125 through the use of a rivet, or the sear lever 117 may include a projection that extends through the bushings 121, through the sear lever opening 123 in the cylinder, and that is in communication with the firing pin 125 by, for example and without limitation, welding. As such, the firing pins 125 are configured to move axially and concurrently with the sear lever 117.

In the exemplary embodiment of FIG. 1, including two cylinders 101A, 101B, the sear lever 117 is attached to the firing pins 125 in both cylinders 101A, 101B. In an embodiment with more or fewer cylinders 101A, 101B, the sear lever 117 may be attached to more or fewer of the respective firing pins 125.

A trigger support or bracket 157 may be fixed to the bridge 155 and positioned laterally between the cylinders 101A, 101B. The trigger attachment bracket 157 may be formed of a metal such as, for example and without limitation, aluminum or an aluminum alloy. The trigger attachment bracket 157 may include a groove extending between the longitudinal axes of the cylinders 101A, 101B. The trigger attachment bracket 157 may include a void 144 for a trigger safety 143, described below, and a void 148 for the trigger 109, described below, that extend through the trigger attachment bracket 157 along an axis that is perpendicular to the longitudinal axes of the cylinders 101A, 101B.

The trigger 109 may be a metal such as, for example and without limitation, aluminum or an aluminum alloy. The trigger 109 illustratively includes a release portion 198 and a catch portion 197 positioned on opposing sides of a pivot. More particularly, the trigger 109 may include one or more pins 196 that extend through the trigger void 148 in the trigger attachment bracket 157 and held in place by one or more clips 156 or other retaining structures, creating a pivot for the trigger 109 between an open position, when the release portion of the trigger 109 is positioned relatively closer to the trigger attachment bracket 157, and a closed position, when the release portion 198 of the trigger 109 is positioned relatively farther away from the trigger attachment bracket 157. As such, the catch portion 197 of the trigger 109 is positioned relatively farther away from the trigger attachment bracket 157 (and the sear lever 117) in the open position, and is positioned relatively closer to the trigger attachment bracket 157 (and the sear lever 117) in the closed position. A trigger spring 111 is positioned between the trigger attachment bracket 157 and the trigger release portion 198, biasing the trigger release portion 198 away from the trigger attachment bracket 157 and toward the closed position. A trigger spring stop 112 may be within the spring and may be fixed to the trigger 109, preventing the trigger release portion 198 from striking the bridge 155.

When the sear lever 117 is pulled toward the first end 190 of the cylinder against the bias of the spring 192, and the trigger 109 is in a closed position, the catch portion 197 of the trigger 109 rests closer to the bridge 155 than the top of the sear lever 117, retaining the sear lever 117 toward the first end 190 of the cylinder against the bias of the spring 192. If the trigger 109 is in an open position, the catch portion 197 of the trigger 109 is farther away from the bridge 155 than the sear lever 117 base, allowing the sear lever 117 and firing pins 125 to travel freely along the longitudinal axis of the cylinder, subject to the bias of the springs 192 (and if trigger safety 143 is in a firing position).

The trigger safety 143 may be a metal, and may include a trigger safety selector 149 and a trigger safety cylinder 145. The trigger safety selector 149 and the trigger safety cylinder 145 may be machined or stamped from a single piece of metal, or may be two or more parts that are attached together. The trigger safety selector 149 has a flat shape and is rotatable between a first (safe) position and a second (firing) position. The side of the trigger safety selector 149 showing to the user in the first (safe) position may have a different texture than the side of the selector showing to the user in the second (firing) position, in addition to having one or more other markings to indicate whether the trigger safety selector 149 is in the first position or the second position. The trigger safety selector 149 may be rotatable while the trigger 109 is in the closed position. The trigger safety cylinder 145 may extend through a void 144 in the trigger attachment bracket 157, may be secured with one or more clips 146 or other retaining structure, and may be closer to the bridge 155 than the trigger 109.

Figure 7:
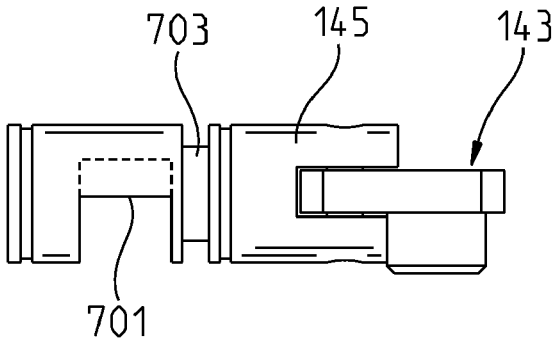
FIG. 7 is a top view of a trigger safety cylinder according to an embodiment of the present disclosure.
Figure 8:
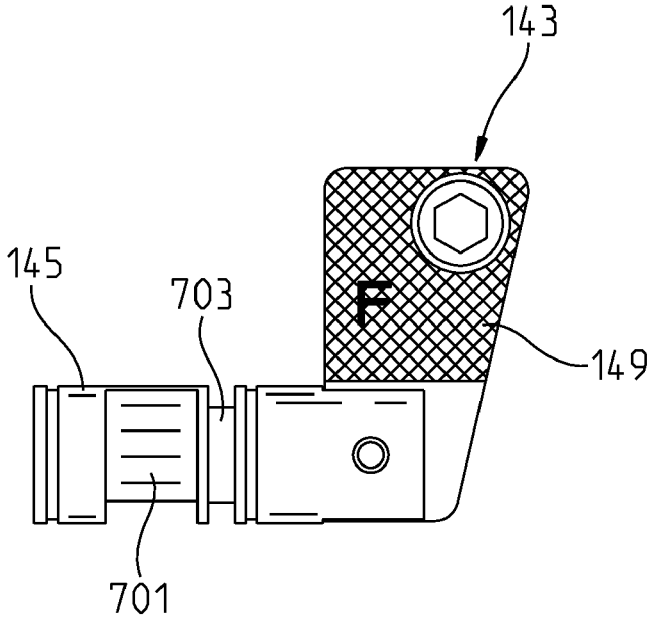
FIG. 8 is a top view of a trigger safety selector and trigger safety cylinder according to an embodiment of the present disclosure.

Also shown in FIGS. 7 and 8, the trigger safety cylinder 145 may include one or more projections or indentations 701 that selectively interact with the trigger 109. If the trigger safety selector 149 is in the first position, the trigger safety cylinder 145 is rotationally positioned within the trigger attachment bracket 157 such that the trigger 109 contacts the trigger safety cylinder 145 before the trigger 109 pivots sufficiently such that the sear lever 117 has enough clearance under the catch portion 197 of the trigger 109 to move toward the second end 191 of the cylinder (i.e., the trigger 109 may not be able to be fully depressed). If the trigger safety selector 149 is in the second position, the trigger safety cylinder 145 is rotationally positioned within the trigger attachment bracket 157 such that the trigger 109 is received within the indentation 701 of the trigger safety cylinder 145 (i.e., the trigger 109 may be able to be fully depressed). The trigger safety cylinder 145 may thus present a mechanical stop to prevent the trigger 109 from being fully depressed such that the catch portion 197 restrains movement of the sear lever 117 and hence, firing pins 125. In an illustrative embodiment, when the trigger safety selector 149 is greater than 30 degrees from the second (firing) position, the trigger safety cylinder 145 may prevent the trigger 109 from being fully depressed. The trigger safety cylinder 145 may also includes groove 703 in which is deposited an o-ring 903, shown in FIG. 9. The o-ring 903 may be an elastomeric compound or other deformable compound, and may be deposited into the groove 703, which may be spaced within the void 144, adding friction to the movement of the trigger safety cylinder 145 and the trigger safety selector 149 and preventing the trigger safety cylinder 145 and the trigger safety selector 149 from freely rotating within the void 144.

The secondary safety 135 may include a cylindrical pin 141 that extends through secondary safety openings 180 of the cylinders 101A, 101B, and a releasable detent 139 operably coupled to a button 137 that allows the cylindrical pin 141 to releasably positioned within the cylinders 101A, 101B. The detents 139 are illustratively spring biased and positioned on the outer surface of the pin 141 at an end opposite the button 137, so that pressing the button 137 may retract the detents 139 into the cylindrical pin 141, and releasing the button 137 may extend the detents 139 out of the cylindrical pin 141. The cylindrical pin 141 with the projections 139 retracted may be narrower than the secondary safety openings 180 of the cylinders 101A, 101B, and the cylindrical pin 141 with the projections 139 extended may be larger than the secondary safety openings 180 of the cylinders 101A, 101B.

The secondary safety openings 180 on the cylinders 101A, 101B are arranged so that the cylindrical pin 141 of the secondary safety 135 may extend through one of the secondary safety openings 180, through the inner portion of the cylinder, out of the other secondary safety openings 180 for the cylinder, and through a secondary safety opening 180 for another cylinder, until the cylindrical pin 141 passes through each of the cylinders 101A, 101B and out of the last cylinder 101B in the firing device 100. In an embodiment, the secondary safety openings 180 are arranged on the cylinders 101A, 101B so that, if the secondary safety 135 is installed, the firing pin 125 in the cylinders 101A, 101B will strike the cylindrical pin 141 of the secondary safety 135 before the firing pin 125 strikes the firing pin stop lock screw 131. In an illustrative embodiment, the secondary safety 135 may not be installed within the cylinders 101A, 101B unless the sear lever 117 is pulled toward the first end 190 of the cylinder 101A, 101B against the bias of the spring 192, and is held by the catch portion 197 of the trigger 109. In other words, the firing pins 125 do not rest against the secondary safety 135 when the sear lever 117 is in its firing (retracted) position but a gap is provided therebetween.

A lanyard 107 may be attached to the eye hook 105 on one or more of the threaded caps 103, and may also be attached to an attachment point on the secondary safety 135. The lanyard 107 ensures that the secondary safety 135 continues to be attached to the firing device 100, even if the secondary safety 135 is not disposed within the cylinders 101A, 101B. The lanyard 107 may be a metal wire or metal wires, for example a braided stainless steel wire, and may be coated with another material. For example, and without limitation, the lanyard 107 may be coated with a plastic or rubber material, or the wire of the lanyard 107 may be chemically treated to improve wear resistance or to change other properties such as color or texture. The attachment of the lanyard 107 to the secondary safety 135 and the eye hook 105 may be fixed, or may be releasable, so that the secondary safety 135 may be detached from the firing device 100.

A catch 151 is supported below the cylinders' 101A, 101B proximate ends 191. The catch 151 may include projections to allow for releasable attachment to a part of one or more detonators. The catch 151 may be removable, and may be attached to the cylinders 101A, 101B. The cylinders 101A, 101B, for example, may include projections or indentations that may engage with similar projections or indentations on the catch 151. The catch 151 may be made from a metal such as aluminum or aluminum alloy, or may be made from steel or a steel alloy. The catch 151 may be attached to the cylinders 101A, 101B by screws 901, shown in FIG. 9, or other fasteners. In an illustrative embodiment, the screws are cross-head and are countersunk into countersink areas (not shown) in the catch 151. The screws 901 may be in communication with one or more voids (not shown) in the cylinders 101A, 101B to secure the catch 151 to the cylinders 101A, 101B.

The firing device 100 may be positioned in a "safe" position, an "armed" position, and a "fired" position. In the safe position (i.e., firing (retracted) position), the sear lever 117 is positioned towards the first end 190 of the cylinders 101A, 101B, and the top surface 603 of the sear lever 117 is engaged with the catch portion 197 of the trigger 109, so that the catch portion 197 of the trigger 109 holds the sear lever 117 towards the first end 190 of the cylinders 101A, 101B, against the bias of the springs 192 in the cylinders 101A, 101B. The secondary safety 135 is inserted into the cylinders 101A, 101B, and the button 137 on the secondary safety 135 is not depressed, so that the projections 139 on the secondary safety cylindrical pin 141 are extended. The trigger safety 143 is illustratively in the first (safe) position, preventing the trigger 109 from being depressed.

In the armed position, the secondary safety 135 has been removed from the cylinders 101A, 101B by depressing the button 137 on the secondary safety 135, thus retracting the projections 139 of the cylindrical pin 141, and the secondary safety 135 has been removed. The secondary safety 135 may be attached to the firing device 100 by the lanyard 107. The trigger safety 143 has been rotated to the second (firing) position.

In the fired position, the trigger 109 has been depressed, overcoming the bias from the trigger spring 111. The sear lever 117, no longer held in place by the catch portion 197 of the trigger 109, is biased toward the second end 191 of the cylinders 101A, 101B by the spring 192, and the firing pins 125 in the cylinders 101A, 101B rest against the firing pin stop 132. The tips 129 of the firing pins 125 extend through the firing pin stops 132 to strike the non-electric detonators 194.

In operation, the firing device 100 may begin at, for example, the armed position. A user inserts a non-electric detonator 194 within the second end 191 of the cylinder. The non-electric detonator 194 may be cylindrical, and the diameter of the non-electric detonator 194 may be smaller than the diameter of the inner surface of the cylinders 101A, 101B. The non-electric detonator 194 may include threads 199 disposed on the outer surface, so that the threads 199 of the non-electric detonator 194 may engage with the threads (not shown) disposed on the inner surface of the second end 191 of the cylinder, holding the non-electric detonator 194 in place. In another embodiment, the non-electric detonator 194 may be held in place within the cylinder via, for example and without limitation, a friction fit, or a clip or other device disposed outside of the cylinders 101A, 101B to hold the non-electric detonator 194 in place within the cylinders 101A, 101B. The non-electric detonator 194 may be positioned within the cylinder so that the firing pin 125 may strike the non-electric detonator 194, and the firing pin stop 132 may be adjusted to ensure contact between the firing pin 125 and the non-electric detonator 194. The firing pin stop screws 131 are secured against the firing pin stops 132 to prevent rotation after adjustment of the firing pin stops 132. The non-electric detonator 194 may be attached to or in communication with an amount of explosives via a fuse, such as detonator cord (not shown).

When a command to fire is given, the user may remove the secondary safety 135 by pressing the button 137 on the secondary safety 135, retracting the projections 139 of the cylindrical pin 141, and removing the secondary safety 135 from the cylinders 101A, 101B. The user may then rotate the trigger safety 143 from the first position to the second position, and may depress the trigger 109, overcoming the bias of the trigger spring 111. The trigger 109 may pivot within the trigger attachment bracket 157, and the catch portion 197 of the trigger 109 no longer restricts the sear lever 117. When the catch portion 197 of the trigger 109 is no longer closer to the bridge 155 than the sear lever 117, the sear lever 117 is biased by the springs 192 within the cylinders 101A, 101B to move the firing pin 125 towards the second end 191 of the cylinders 101A, 101B. The firing pins 125 and the sear lever 117 move toward the second end 191 of the cylinders 101A, 101B, and strikes the non-electric detonators 194 positioned therein. The non-electric detonator 194 may ignite, initiating detonation of the amount of explosives in communication with the non-electric detonator. The firing pins 125 may continue to travel in the direction of the second end 191 of the cylinders 101A, 101B, until the firing pins 125 strike the firing pin stop lock screws 131 and movement ceases, and the firing device 100 is in the fired position.

After the firing device 100 is in the fired position, the user may remove the non-electric detonators 194 from the firing device 100. The user may then push the sear lever 117 towards the first end 190 of the cylinders 101A, 101B, overcoming the bias of the springs 192 within the cylinders 101A, 101B. Movement of the sear lever 117 may push the catch portion 197 of the trigger 109 away from the bridge 155, overcoming the bias of the trigger spring 111, so that the catch portion of the trigger 109 may ride along or above the upper surface 603 of the sear lever 117, while the sear lever 117 is pulled towards the first end 190 of the cylinders 101A, 101B. When the sear lever 117 is closer to the first end 190 of the cylinders 101A, 101B than the catch portion of the trigger 109, the bias of the trigger spring 111 pushes the catch portion toward the bridge 155, holding the sear lever 117 in place. The user may then rotate the trigger safety 143 from the second position to the first position, and the user may press the button 137 of the secondary safety 135, retracting the projections (139) on the cylindrical pin 141. The user may then position the secondary safety 135 within the cylinders 101A, 101B, and may release the button 137, extending the projections (139) on the cylindrical pin 141 and preventing the secondary safety 135 from being removed. The firing device 100 is then in the safe position as detailed above.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A firing device, comprising:

a first hollow cylinder;

a second hollow cylinder laterally spaced from and extending substantially parallel to the first hollow cylinder, each of the first and second hollow cylinders having a longitudinal axis, an inner surface and an outer surface, and extending longitudinally between a first end and a second end, each said first and second hollow cylinders is further formed with an elongated opening through a side wall of each of said hollow cylinders;

a spring disposed in each of the first and second hollow cylinders;

a firing pin disposed in each of the first and second hollow cylinders, wherein each spring is positioned between the first end of one of the first and second cylinders and the respective firing pin;

a lever structure having a first and second portion, said second portion having a section formed with a first and second elongated aperture, said lever structure is coupled to the firing pins via at least one fastener which couple said lever structure to the firing pins, said firing pins are disposed in each of the first and second hollow cylinders through said elongated openings in the first and second hollow cylinders, the lever structure positioned outside of the first and second hollow cylinders and configured to move longitudinally in response to movement of the firing pins;

a first bushing disposed between a first portion of the lever structure and the first hollow cylinder, the first bushing interposed within the opening of the first hollow cylinder; and a second bushing disposed between the second portion of the lever structure and the second hollow cylinder, the second bushing interposed within the opening of the second hollow cylinder;

wherein said first and second bushings further comprise a radial flange located between a first end and a second end of said first bushing, said flange being disposed on the bushing between a bottom of said lever structure and said outer surface of said hollow cylinders such that frictional contact is eliminated between the first and second hollow cylinder and the lever structure, said second end of said first and second bushing are respectively positioned in contact with a mating surface of said first and second firing pins;

wherein said elongated openings, elongated apertures, said fasteners, said bushings are sized to permit said lever structure to permit the firing pins to move within said hollow cylinders significantly independent of mechanical force interference from one firing pin to the other firing pin as well as permitting said firing pins to be positioned substantially ahead or rearward of each other including where one pin is fully forward against a stop and the other pin is fully rearward against said springs respectively disposed in each said hollow cylinder.

2. The firing device of claim 1, wherein the bushings are formed of a material harder than that of the cylinders.

3. The firing device of claim 1, wherein the first hollow cylinder and the second hollow cylinder are milled from a single piece of aluminum.

4. The firing device of claim 3, further comprising at least one recess positioned on each of the first and second hollow cylinders that interact with one or more projections from one or more initiators, and wherein the thickness of the first and second hollow cylinders is sized to prevent damage to the first and second hollow cylinders during use.

5. The firing device of claim 1, wherein the firing pins disposed in each of the first and second hollow cylinders includes a flat portion that engages with the first and second bushings.

6. The firing device of claim 1, wherein the first and second bushings are contoured to the outer surface of the first and second hollow cylinders such that the first and second bushings are substantially flush with the first and second hollow cylinders.

7. The firing device of claim 1, wherein the first and second hollow cylinders further comprise safety apertures positioned perpendicular to the longitudinal axis of the first and second cylinders, and further comprising a cylindrical pin positioned through the safety apertures and preventing the firing pins from moving along the longitudinal axis of the first and second cylinders.

8. The firing device of claim 1, further comprising stop locks disposed within each of the first and second hollow cylinders and positioned between the firing pin and the second end of the first and second hollow cylinders, and firing pin stop lock screws abutting each of the stop locks, to prevent the stop locks from further movement within the first and second hollow cylinders.

9. The firing device of claim 1, wherein the first end of each of the first and second cylinders is substantially closed.

10. The firing device of claim 1, wherein the first end of each of the first and second cylinders further comprise threads disposed on the inner surface of the first end.

11. The firing device of claim 1, further comprising one or more threaded caps corresponding to the first and second hollow cylinders, the threaded caps substantially cylindrical with threads disposed on the outer surface, the threads releasably engaged to the threads disposed on the inner surface of the first end of each of the first and second cylinders.

12. The firing device of claim 11 further comprising a trigger assembly in communication with the each of the first and second hollow cylinders, the trigger assembly comprising a trigger attachment bracket in communication with each of the first and second cylinders, a trigger in communication with the trigger attachment point and in releasable communication with the lever structure, and a trigger safety, the trigger safety configured to prevent the trigger from releasing from the lever structure.

13. The firing device of claim 12, wherein the trigger safety comprises a safety selector in communication with a safety cylinder.

14. The firing device of claim 1, further comprising a catch releasably coupled to the first and second hollow cylinders to releasably attach to one or more detonators.

15. The firing device of claim 1, wherein the firing pins are adapted to initiate percussion primed explosive trains.

16. The firing device of claim 1, wherein the first and second hollow cylinders are adapted to releasably engage with percussion primed explosive trains.

17. A firing device, comprising:

a first hollow cylinder having an inner surface and an outer surface, the first hollow cylinder comprising a first end and a second end, the first end including threads disposed on the inner surface, and the second end configured to couple with a non-electric detonator;

a threaded cap corresponding to the first hollow cylinder, the threaded cap substantially cylindrical with threads disposed on the outer surface, the threads releasably engaged to the threads disposed on the inner surface of the first end of the first hollow cylinder;

a first spring disposed in the first hollow cylinder;

a first firing pin disposed in the first hollow cylinder, wherein the spring is positioned between the first end of the first hollow cylinder and the first firing pin;

a lever structure having a first and second lever structure portion, said first lever structure portion is formed with a first elongated aperture, said second lever structure is formed with a section extending substantially perpendicular to a longitudinal axis of the first hollow cylinder, and coupled to the firing pin disposed in the first hollow cylinder through an elongated opening in the first hollow cylinder, the lever structure positioned outside of the first hollow cylinder and configured to move longitudinally in response to movement of the first firing pin;

a first fastener adapted to couple said first lever structure portion to said first firing pin through said first elongated aperture and said first opening;

a first bushing disposed around said first fastener and between the lever structure and the first hollow cylinder, wherein the first bushing is interposed within the opening of the first hollow cylinder and said first elongated aperture;

a trigger assembly comprising a trigger attachment point in communication with the first hollow cylinder, a trigger in communication with the trigger attachment point and in releasable communication with the lever structure, and a trigger safety, the trigger safety configured to selectively prevent the trigger from releasing the lever structure when said first firing pin is positioned to compress said first spring;

wherein said first bushing further comprises a radial flange located between a first end and a second end of said first bushing such that frictional contact is eliminated between said first hollow cylinder and a side of said first portion of the lever structure, said second end of said first bushing is positioned in contact with a mating surface of said first firing pin.

18. The firing device of claim 17, further comprising a secondary safety structure adapted to be inserted into said first hollow cylinder through at least one side of said first hollow cylinder, wherein said secondary safety structure is disposed in said first hollow cylinder to prevent said first firing pin from fully traversing said first hollow cylinder to an end opposite where said first spring is disposed.

19. The firing device of claim 17, wherein the trigger safety comprises a first end portion and a second end portion opposite of said first end portion, said first end portion is formed with a safety selector protrusion section in communication with said trigger safety's second end portion, wherein said trigger safety's second end portion is formed with a channel which is formed partially through a side of said trigger safety in proximity to second end portion, wherein said channel is formed to permit a section of said trigger to traverse through said channel when said safety selector protrusion section is in a first position and prevent said trigger to be depressed when said trigger safety is moved to a second position.

20. The firing device of claim 17, further comprising:

a second hollow cylinder including a first end and a second end, the second hollow cylinder extending in parallel relation to, and laterally spaced from, the first hollow cylinder;

a spring disposed in the second hollow cylinder;

a second firing pin disposed in the second hollow cylinder, wherein the spring is positioned between the first end of the second hollow cylinder and the second firing pin;

a second fastener adapted to couple said second firing pin and a second section of said lever structure with an interference fit between a retaining section of said second fastener and an upper surface of said lever structure; and a second bushing disposed around said second fastener, said second bushing is further disposed in said opening of the second hollow cylinder and between the lever structure and the second hollow cylinder, said second bushing further comprises a radial flange located between a first end and a second end of said second bushing such that frictional contact is eliminated between said second hollow cylinder and a lower side of said lever structure, said second end of said second bushing is positioned in contact with a mating surface of said second firing pin;

wherein the lever structure is coupled to the firing pin disposed in the second hollow cylinder through an opening in the second hollow cylinder, the lever structure being positioned outside of the first hollow cylinder and the second hollow cylinder and configured to move longitudinally in response to movement of the firing pins, wherein said lever structure further comprises a first and second elongated opening which permits a first and second fastener that couples said first and second firing pins to said lever structure.

21. A method of manufacturing a firing device, comprising the steps of:

providing a first and second hollow cylinder, each said hollow cylinders is further formed with an elongated opening through a side wall of each of said hollow cylinders;

providing a first and second firing pin and respectively disposing said pins in said first and second hollow cylinders;

providing and adjusting a first and second stop lock respectively for said first and second hollow cylinders to define a set point for said first and second firing pins supported for sliding movement within the hollow cylinders;

providing a first and second bushing structure each having a radial flange located between a first and second end of said bushing structure, each said bushing structure adapted to have a passage running through the bushing structure;

providing a lever structure external to the cylinders and supported for movement with the firing pin, said lever structure further having a first and second portion, said second portion is formed with a first and second elongated aperture, said lever structure is coupled to the firing pins via at least one fastener which couples said lever structure to said firing pins, wherein said first and second bushing structures are respectively disposed around said first and second fasteners, each said radial flange positions said lever structure so that it has a clearance fit with said hollow cylinders, said fastener and bushing structure passes through said first elongated opening, said second elongated opening, said first elongated aperture and said second elongated aperture; and providing a trigger to releasably secure the lever structure in a firing position.

22. The method of claim 21, wherein the lever structure is insulated from the cylinder by depositing a bushing therebetween, wherein the bushing is made of stainless steel.

23. The method of claim 21, further comprising providing a trigger safety operable to move between a first position and a second position, wherein the trigger is prevented from activating if the trigger safety is in the first position.

24. The method of claim 21, further comprising providing a releasable catch in communication with the hollow cylinder, and wherein the detonator is held in place by the catch.

25. The method of claim 21, wherein the hollow cylinder is formed from a single piece of aluminum.

26. A firing device comprising:

a first and second housing having a longitudinal passage within each of said housings and further formed with an elongated housing aperture through opposing side walls of each of said housings running laterally in relation to said longitudinal passage;

a first and second firing pin body;

a lever section, wherein said lever section has a first and second portion, said second portion having a first and second side that opposes each other where said second side faces away from said first portion, said second portion is formed with a planar area having first and second elongated apertures;

a first bushing body and a second bushing body;

a first and second fastener structure adapted to respectively couple said first and second firing pin body, wherein said first and second bushing body is formed to fit respectively around said first and second fastener and further having a shoulder adapted to support said lever section and ensure a clearance between a lower side of said lever section and an upper section of said housing;

at least one driving mechanism section adapted to apply a mechanical force to said first and second firing pin bodies;

a trigger mechanism adapted to releasably retain said lever section and firing pin bodies in a first firing position where said firing pin bodies are in a ready to fire position in relation to said driving mechanism section by releasably engaging with a section of said lever section;

a first safety interlock structure adapted to prevent said trigger mechanism from releasing said lever section in a first position and further is adapted to permit said trigger mechanism to move and release said lever section when rotated into a second position; and a removable second safety interlock structure adapted to be removeably inserted into side wall apertures formed into said housings and thereby preventing said firing pin bodies from fully traversing said longitudinal passage when inserted.

27. A firing device as in claim 26, wherein said first and second firing pin body has a first and second firing pin end section, wherein each said firing pin body has a mating surface formed on a side of each firing pin body between a center point of said firing pin bodies and said first firing pin end section, wherein said first and second firing pin bodies are adapted to move longitudinally within said longitudinal passage.

28. A firing device as in claim 26, wherein said firing pin bodies, fasteners, bushings, lever section and said housing are adapted to permit a plurality of firing pin body positions for said first and second firing pin bodies which permit said first and second firing pin body to be positioned substantially independent of each other, said plurality of firing pin positions including a first firing pin body position and a second firing pin body position, said first firing pin body position having one section of said firing pin body extended within said longitudinal passage against a firing pin stop section such that said driving mechanism is at a farthest extended state, said second firing pin body position having said firing pin body at an opposing section of said longitudinal passage such that said driving mechanism is in an energized or adapted to impart a mechanical force on said firing pin body sufficient to propel said firing pin body forward through said longitudinal passage upon release by said trigger mechanism.

29. A firing device as in claim 26, wherein said first bushing body and a second bushing body formed substantially into an elongated body with a longitudinal channel running through each said bushing body through a longitudinal axis in each said bushing body and said shoulder formed in an outer surface of said bushings at a first distance from a first end of each said bushing body and a second distance from a second end of each said bushing body, said first end of each bushing body coupling to said lever section, said second end of each bushing body interfacing with said first and second firing pin bodies respectively through said elongated housing apertures, wherein said mating surface of said first and said second firing pin bodies are formed to conform to the shape of said second end of a respective said bushing body.

30. A firing device as in claim 28, wherein said driving mechanism comprises a first and second driving mechanism respectively disposed in relation to each said longitudinal passage, said driving mechanism having two driving mechanism states including a first driving mechanism state and a second driving mechanism state, wherein said first driving mechanism state is the driving mechanism in a fired position, said second driving mechanism state has said driving mechanism in said ready to fire position, wherein said driving mechanism provides or directs energy to move said firing pin bodies from said second firing pin body position to said first firing pin body position.

31. A firing device as in claim 28, wherein said trigger mechanism engages said lever in a second lever position and releases said lever allowing the driving mechanism to propel the firing pin bodies through the longitudinal passage from said second firing pin body position to said first firing pin body position.

32. A firing device as in claim 26, wherein said first safety interlock structure comprises a safety lever protrusion and a rotatable body disposed within an attachment section on said first and second housing, said first safety interlock structure further comprising a trigger channel formed part-way through a side section of said first safety interlock structure's body in proximity to an end of said first safety interlock opposing said lever protrusion, wherein said first safety interlock prevents said trigger mechanism from moving and thereby releasing said lever section in a first position, said first safety interlock and permits said trigger mechanism to move to release said lever section in a second position when said safety interlock structure is rotated and thereby permits a section of said trigger mechanism to move into said trigger channel.

33. A firing device as in claim 28, wherein said firing pin bodies have a first width and a second width, said first width is a control tolerance within said longitudinal passage, said second width is a control tolerance configured to respectively engage mating surfaces of said bushings, said bushing bodies having second distance greater than the distance from a face of firing pin bodies at second width of said firing pin bodies to an outer surface of the elongated housing aperture to allow the shoulder of said bushings to ride above and out of contact with the outer surface of the elongated housing aperture, said lever having a thickness smaller than first distance of bushing bodies such that the lever can move freely between the coupling structures and the said elongated apertures of the lever to loosely couple the firing pin bodies in such a way as to allow significant independence of movement of firing pin structures with respect to said longitudinal axis of said housings, said elongated apertures of said lever are adapted to allow each firing pin body to move from said second firing pin body position to first firing pin body position independently while the other firing pin body is maintained in second firing pin body position.

* * * * *